United States Patent [19]

Renaldo

[11] 4,146,981

[45] Apr. 3, 1979

[54] FOOTWEAR STRUCTURE WITH INTERCHANGEABLE ELEMENTS

[76] Inventor: Leandre Renaldo, via S. Marco, Padova, Italy

[21] Appl. No.: 685,235

[22] Filed: May 11, 1976

[51] Int. Cl.[2] ..... A43B 3/24; A43C 15/00; A43B 13/28; A43B 21/36

[52] U.S. Cl. ..... 36/100; 36/15; 36/24.5; 36/42

[58] Field of Search ..... 36/100, 101, 86, 31, 36/11.5, 15, 24.5; 32/42

[56] References Cited

U.S. PATENT DOCUMENTS

| | | | |
|---|---|---|---|
| 2,299,840 | 10/1942 | Merritt | 36/24.5 |
| 2,707,341 | 5/1955 | Romano | 36/100 |
| 2,759,284 | 8/1956 | Santisi | 36/86 |
| 2,873,540 | 2/1959 | Murphy | 36/101 |
| 2,912,772 | 11/1959 | Harrison | 36/24.5 |

FOREIGN PATENT DOCUMENTS

| | | | |
|---|---|---|---|
| 1178917 | 5/1959 | France | 36/24.5 |
| 1353585 | 1/1964 | France | 36/24.5 |
| 594034 | 10/1947 | United Kingdom | 36/101 |

*Primary Examiner*—Patrick D. Lawson
*Attorney, Agent, or Firm*—Guido Modiano; Albert Josif

[57] ABSTRACT

Footwear structure comprising essentially a lower portion and an upper portion or vamp, associated with said lower portion. The lower portion defines generally the sole and heel of the footwear. It comprises substantially a front element, a rear element and an intermediate supporting element or web. The web is associable rigidly, at its ends, with the front and rear elements for engagement therewith.

1 Claim, 10 Drawing Figures

FOOTWEAR STRUCTURE WITH INTERCHANGEABLE ELEMENTS

BACKGROUND OF THE INVENTION

This invention relates to a footwear structure comprised of interchangeable elements.

The traditional footwear article comprises generally an upper portion, called vamp or uppers, and a lower portion constituting the sole thereof and connected to said vamp or uppers.

To the rear portion of said sole, and beneath it, a heel is then associated rigidly. The above should be taken merely as a generalization, and is of reference value only. There exist, moreover, highly specialized or sophisticated implementations of such a footwear concept, e.g. in order to provide an improved ventilation and better breathing conditions for the wearer's feet; to this end, the sole may be provided with cavities or recesses wherein, most advantageously, inserts are positioned which are made of a material and with a structure such as to favor the ventilation. However, although such implementations represent a positive and noteworthy approach with respect to the traditional footwear design mentioned above, the fact remains that they still include, substantially, a sole associated with a vamp and provided with a heel portion underneath.

Said sole is to meet contradictory requirements: in fact, if at the bending area during the deambulation the shoe is to provide soupleness and flexibility features, at the intermediate area, included between the heel and front portion, it must be sufficiently rigid to provide a supporting structure.

From the considerations set forth above, it is apparent that the prior art footwear articles or shoes are not exempt from drawbacks.

SUMMARY OF THE INVENTION

It is a primary object of this invention to obviate such prior art footwear drawbacks by providing a shoe the sole whereof offers flexibility at its forward or front portion and rigidity at its intermediate or shank portion included between said front portion and the heel.

It is another object of the invention to provide a shoe or footwear article comprising interchangeable elements.

A further object of the invention is to implement, by means of different interchangeable elements, a shoe or footwear article having shapes and structures diversified from one another, while keeping at all times unchanged at least one of said interchangeable elements.

Still another object of this invention is to provide a shoe as mentioned above which, both by reason of the implementation procedure of its component elements and of its assembling simplicity and rapidity, is economically advantageous.

These and other objects, such as will be apparent herein after, are achieved by a footwear structure comprising essentially a lower portion and an upper portion or vamp, associated with said lower portion, characterized in that said lower portion, defining generally the sole and heel of said footwear, comprises substantially a front element, a rear element and an intermediate supporting element or shank or web, said web being associable rigidly, at its ends, with said front end rear elements for engagement therewith.

BRIEF DESCRIPTION OF THE DRAWINGS

Further features and advantages of this invention will be more apparent from the description of eight preferred, though not exclusive, embodiments of a shoe or footwear article according to the invention, illustrated by way of example and not of limitation in the accompanying drawings, where.

DESCRIPTION OF PREFERRED EMBODIMENTS

Figure 1:
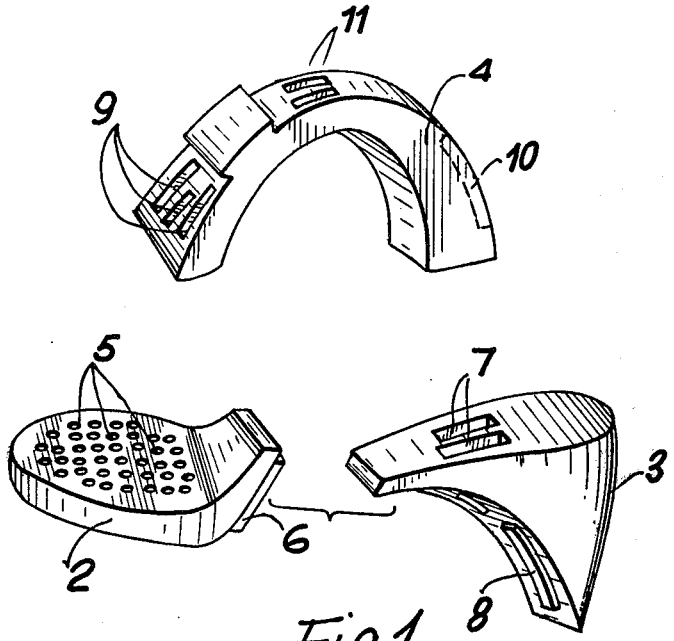
FIG. 1 is a perspective view of the three elements constituting the lower portion of a shoe.
Figure 2:
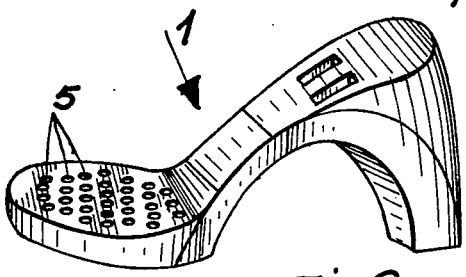
FIG. 2 is a perspective view of the lower portion of a shoe as resulting from the assembling together of the three elements of FIG. 1.

With reference specifically to FIGS. 1 and 2 of the drawings, the reference numeral 1 denotes the lower portion of a shoe wherewith, by methods known per se, the upper portion or vamp, not shown in the drawings, will then be associated.

Said lower portion 1 results from the assembling together of three basic elements, denoted with the reference numerals 2, 3 and 4.

The element 2 is the front or ball portion element of the shoe lower portion, and in the specific embodiment shown, is provided with holes 5 for ventilation and with ribs or ridges 6 for connection, as explained hereinafter, to the element 4.

It appears from the drawing that the separate ball element 2 has integral therewith an upwardly inclined first segment 2*a*, which in assembled condition of the shoe is part of the shank portion 4. It will be further appreciated that the separate ball element has an upwardly facing insole surface 2*b* and a downwardly facing treading surface 2*c*. It will be further noted from the drawing that the upwardly inclined first segment 2*a* extends upwards from the insole 2*b* surface level of the ball portion 2 and that is has an upwardly inclined first mating surface formation 2*d* provided with tongue means 6. Furthermore it appears from the drawing that the first segment 2*a* ends upwardly with a top mating surface formation 2*e* extending transverse to the surface formation 2*d*.

The element 3 is the rear or heel portion element of the shoe lower portion 1, and is provided with through cavities 7, substantially rectangular, effective to favor the ventilation, and with a ridge 8 for connection, as explained hereinafter, to the shank element 4.

It appears from the drawing that the separate heel element 3 has integral therewith a second segment 3*a* which, in assembled condition is partially coextensive with the shank element 4 and constitutes after assemblage a part thereof. It will be further noted from the drawing that the segment 4*a* downwardly slopes from a level of the insole top 3*b* of the heel element and that it has a trading bottom surface 3*d*.

The shank portion element 4, of substantially arcuate shape, constitutes the shoe frame and supporting structure; it will, accordingly, be termed the web of the shoe. It appears from the drawing that the shank element 4 has a segment 4*a* integral therewith which, in assembled condition, is part of the ball portion 2. The shank element has also a second segment 4*b* integral therewith which in assembled condition is part of the heel portion 3. It will be further noted from the drawing that the segment 4*a* extends from the arcuated shank element 4, downwardly from a level thereof corresponding to the level of the insole surface 2*b* thereof, the segment 4*a* having further a treading face 4*c*, which in assembled condition is flush with the treading surface 2*c* of the ball portion. The shank element 4 has further a sloping mating surface formation 4*d* for mating engagement with the upwardly inclined mating surface formation 2*d* and a land formation 4*e* in an intermediate position of the shank element 4 the upper surface of which coincides with the insole face of the shank element, which is in assembled condition flush with the insole top surface 3*b* of the heel element 3. It will be noted that the land formation 4*c* has a first shoulder 4*f* abutting against the top mating surface formation 2*e* and a second shoulder 4*g* opposite thereto and abutting in assembled condition against an abutment edge 3*c* of the heel element 3. It will be further noted that the shank element 4 has integral therewith a segment 4*b* which in assembled condition is part of the heel element 3 and which slopes downwardly substantially from a level thereof corresponding to the level of said insole top 3*b* and having a treading bottom surface 4*k*. It will be further noted from the drawing that the shank element 4 has a further arcuated upwardly convex mating surface 4*h* extending from the land formation 4*e* and recessed thereto, over said segment 4*b* up to the treading bottom surface thereof. It is further noticeable from the drawing that the heel element has a segment 3*a* which, in assembled condition is part of said shank element 4, the segment 3*a* extending in assembled condition from said land formation 4*e* over said upwardly convex mating surface 4*h* of the shank element 4 and having an abutment edge 3*c* abutting in assembled condition against said second shoulder 4*g* of the land 4*e*. In its front portion, in a longitudinal direction, rectangular cross-sectioned cavities 9 are formed, wherein the ridges 6 of the front element 2 are inserted for engagement therewith. Likewise, at the rear portion, the web 4 is provided with a cavity 10 whereinto the ridge 8 provided at the rear element 3 is inserted for engagement therewith. The web 4, moreover, is provided with through cavities 11, of rectangular cross-section, which, following the assemblage, will align with the through cavities 7 wherewith the rear element 3 is provided.

The web 4, constituting the supporting structure of the shoe, is required to feature rigidity and strength to a remarkable degree; accordingly, and most conveniently, it may be manufactured by injection molding using a suitable material.

Thus, the front element 2, rear element 3 and intermediate element or web 4, are all formed separately, possibly by injection molding, using materials which provide the most convenient characteristics for the functions that said elements are to perform. The assembling of the three elements described may be effected, depending on the materials being used, simply by mutual engagement, as mentioned, or by engagement and bonding with suitable adhesives.

This embodiment is specially advantageous, both because of the capability provided of interchanging the elements making up the shoe lower portion, and because said elements may be produced by injection molding, thus reducing the mold costs, and lastly because each element may be made of the material that best meets their functional requirements. Thus, whereas the element 4 will be made of a strong and highly rigid material, the element 2 may be made of a flexible material.

Figure 3:
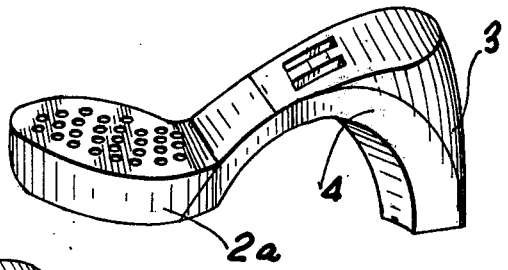
FIG. 3 is a perspective view of a second embodiment of the shoe lower portion as obtained simply by varying the dimensions of the lower and rear elements.
Figure 4:
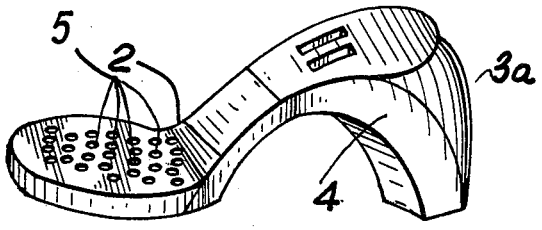
FIG. 4 shows a perspective view of a third embodiment of the shoe lower portion as obtained by further varying the dimensions of the front and rear elements.
Figure 5:
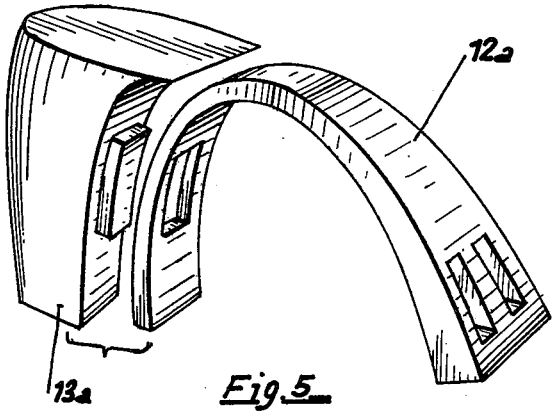
FIG. 5 is a partial perspective view of a fourth embodiment of a shoe lower portion.
Figure 6:
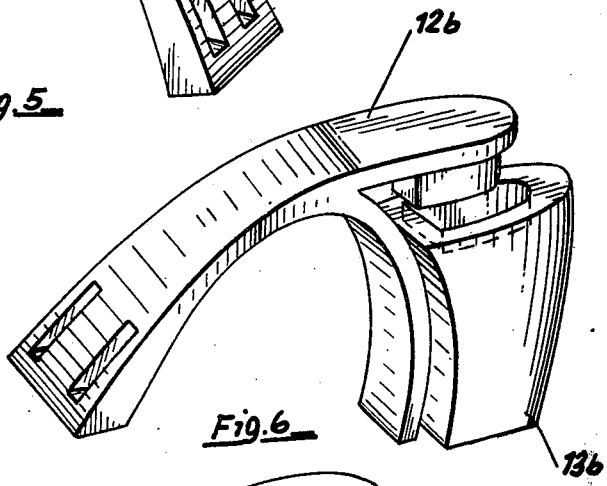
FIG. 6 is a partial perspective view of a fifth embodiment of a shoe lower portion.
Figure 7:
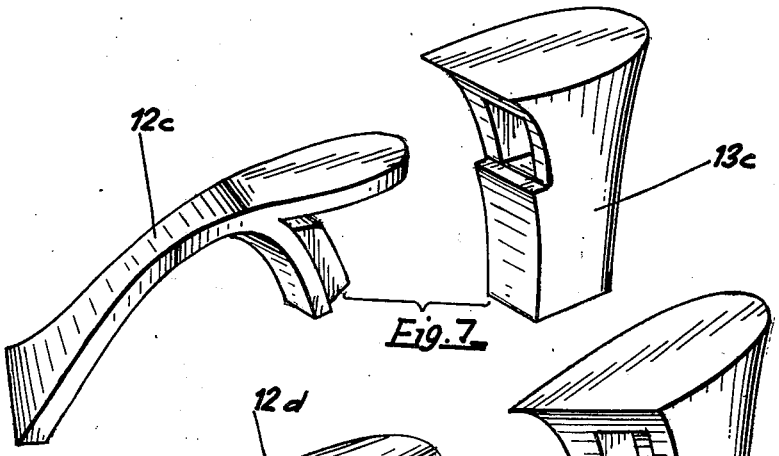
FIG. 7 is a partial perpsective view of a sixth embodiment of a shoe or footwear article.
Figure 8:
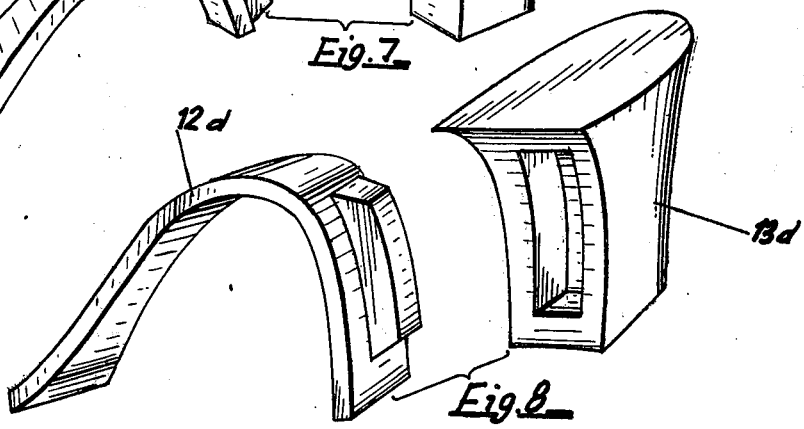
FIG. 8 is a partial perspective view of a seventh embodiment of a shoe or footwear article.

FIGS. 3 and 4 are specially effective to illustrate the resulting advantages, as provided by the interchangeability between the elements making up the shoe lower portion 1.

FIG. 3 shows an alternative embodiment to the embodiment shown in FIG. 2.

In that embodiment, the web 4 has been retained, both in regards to shape and dimensions, as in FIGS. 1 and 2, and the same rear element 3 has also been retained, both in shape and dimensions, as in FIGS. 1 and 2. By contrast, the front element 2 has been changed, and a different front element 2*a* has been adopted which is considerably thicker.

In this manner, it will appear that the pattern of the surface whereon the wearer's foot is going to rest varies entirely from the embodiment of FIG. 2, i.e. using a term currently in use among the experts in the art, the "camber" varies.

In FIG. 4, there is shown a further embodiment alternative to the embodiment of FIG. 3. That same web 4 has been retained therein, and that same front element 2, both in regards to shape and dimensions, as used in FIGS. 1 and 2, whereas the rear element 3 has been changed by adopting a different element 3*a* having different height and inclination. It will be noted that in this case as well the "camber" has been changed. The two examples are obviously of merely illustrative value: it is indeed apparent how it is possible, while keeping unchanged the web 4, to vary simultaneously the rear and front elements in all the possible combinations.

FIGS. 5, 6, 7, and 8 show alternative embodiments to the embodiment shown in FIGS. 1, 2, 3, and 4. In such figures, there are shown intermediate elements or webs, 12*a*, 12*b*, 12*c*, and 12*d*, having the same basic characteristics as the web 4, being associable in various ways to the corresponding rear elements 13*a*, 13*b*, 13*c*, and 13*d*; the front element has been omitted from the figures since, most conveniently, the element 2 may be used.

It should be noted that, whereas in the embodiment of FIGS. 1 and 2, 3 and 4, the intermediate element 4, in addition to acting as a supporting structure also acted as a heel, in the embodiments of FIGS. 5, 6, 7, and 8, the intermediate elements 12*a*, 12*b*, 12*c*, and 12*d*, only function as supporting structures, the heel function being performed by the rear elements 13*a*, 13*b*, 13*c*, and 13*d*.

Nevertheless, as it appears clearly from the drawing the portion 112*a* which is integral with the shank portion 12*a* is in assembled condition a segment which is a component part of the heel 13*a*. Furthermore, the portion 113*a*, which is integral with the heel 13*a* is in assembled condition a segment which is a component part of the shank 12*a*. The same considerations apply also for the segments 112*b*, 113*b* and 112*c*, 113*c* as well as 112*d* and 113*d*.

Figure 9:
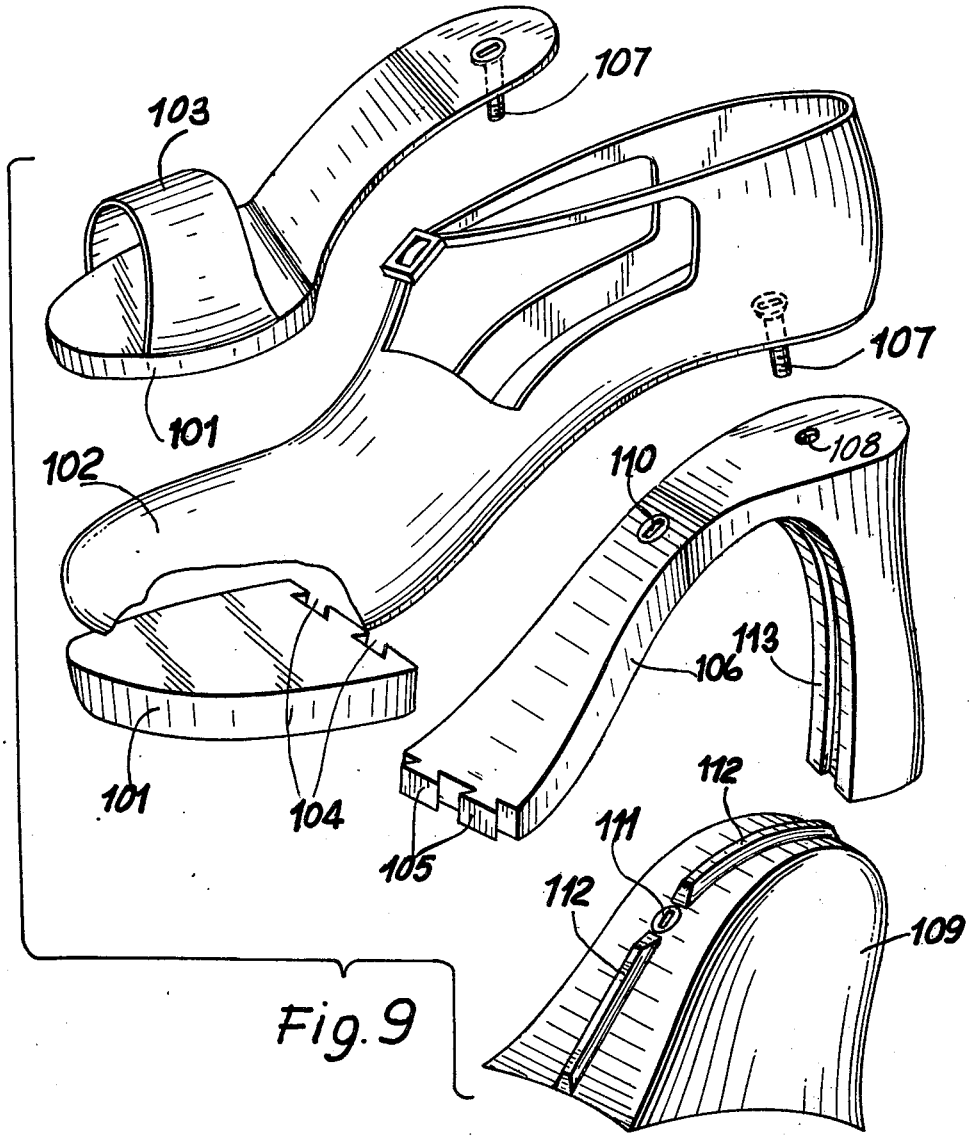
FIG. 9 is an exploded view of an eighth variation with two different vamps.
Figure 10:
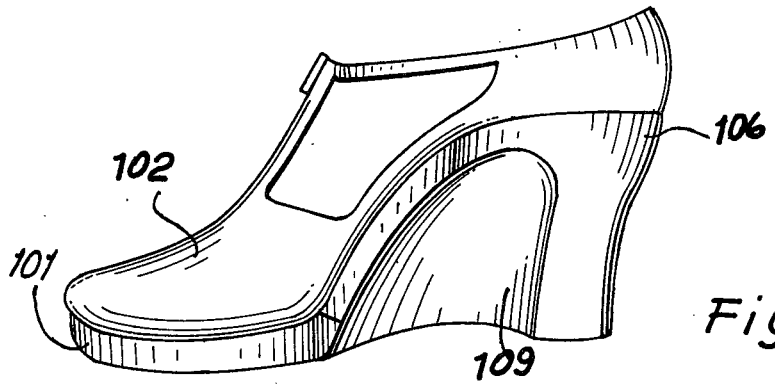
FIG. 10 is a general view of the variation of FIG. 9.

A further variation is shown in FIG. 9 and in FIG. 10, where the shoe comprises a front portion 101 being essentially the sole resting on the ground and rigidly associated with a vamp 102 or alternatively, as a variations thereto, with a second type of vamp 103. Said front portion 101 is so shaped at the rear as to present a plurality of joints 104, implemented here as dovetails, which are effective to engage with complementary joints 105 formed in the front area of the filler and heel section 106 manufactured as a single piece. The two portions, in addition to engaging with each other through the joints 104 and 105, are kept together by a mechanical connection such as a screw or snap joint, located at the jointing area and not shown in the drawings.

As it appear clearly from the drawing, the segment 101*a* of the ball portion 101 is in assembled condition a component part of the shank and heel portion 106, whereas the segment 106*a* is in assembled condition a component part of the ball portion 101.

The vamp of the type 102 and 103 are provided at their rear area with a pin 107 of a resilient material which projects downwardly out and is effective to engage in a suitable countersunk hole 108 formed at the top of the heel area section 106. In the lower part or filler of the structure, there may be inserted a filling member 109 held in place by a mechanical connection of the capscrew 110 type and threaded seat 111, and by a centering rib 113 extending longitudinally on the filler area of the element 106.

From the above description it will be apparent that the instant structure is highly functional: on one side, it permits the implementation of a large variety of shoe designs by assembling alternatively a limited number of basic pieces, thereby the number of molds required is reduced and the costs are also reduced; on the other side, it permits the owner and user of a certain number of elements, properly selected to suit one's taste, to compose the design found preferable at a specific time.

From the above, it will be obvious that the objects intended have been fully achieved by the shoe or footwear article according to the invention.

Furthermore, all the details may be substituted for by other technically equivalent elements.

In practicing the invention, the materials, shapes and dimensions used may be any ones to suit specific requirements.

I claim:

1. Footwear construction with interchangeable elements comprising a ball portion having a downwardly facing treading surface and an upwardly facing insole surface, a heel portion having a treading face and an insole top and a shank portion having an upwardly facing insole face, wherein according to the improvement the ball portion is formed as a separate element and includes as an integral part thereof a first segment of said shank portion extending upwards from the insole surface level of said ball portion and having an upwardly inclined first mating surface formation facing said shank portion and a second top mating surface formation extending transverse to said first mating surface formation, said shank portion has an arcuated shape with downwardly facing concavity and is formed as a separate element and includes integral therewith a segment of said ball portion extending from said shank portion downwardly from a level thereof corresponding to the level of said insole surface and having at its end adjacent said ball portion a first treading face in assembled condition flush with said treading surface of said ball portion, said shank portion having a sloping third mating surface formation for mating engagement with said upwardly inclined first mating surface formation and an upwardly protruding land formation in an intermediate position of said shank portion and having an upper surface coinciding with said insole face, said land formation having a first shoulder facing said top mating surface formation and a second shoulder opposite thereto, and wherein said shank portion formed as a separate element includes further integral therewith a segment of said heel portion sloping downwardly from a level thereof corresponding to the level of said insole top and having a treading bottom surface thereof, said shank portion having a further arcuated upwardly convex mating surface formation extending from said land formation thereof and recessed thereto, over said heel portion segment up to said treading bottom surface thereof and wherein said heel portion is formed as a separate element and includes as an integral part thereof a second segment of said shank portion extending in assembled condition from said land formation over said upwardly convex mating surface of said shank portion and having an abutment edge abutting in assembled condition against said second shoulder and wherein said heel portion segment integral with said shank portion has a downwardly concave mating surface formation engaging in assembled condition said upwardly convex mating surface formation facing said mating concave surface and complementar thereto, said first mating surface formation, said sloping third mating surface formation and said upwardly convex mating surface formation and said downwardly concave mating surface formation having respective groove and tongue engagement means for respective mutual detachable engagement therewith.

* * * * *